United States Patent [19]

Neukom

[11] 4,054,018

[45] Oct. 18, 1977

[54] BAG FILLING APPARATUS

[75] Inventor: Chester G. Neukom, Jamestown, N. Dak.

[73] Assignee: Haybuster Manufacturing, Inc., Jamestown, N. Dak.

[21] Appl. No.: 749,052

[22] Filed: Dec. 9, 1976

[51] Int. Cl.[2] ..... B65B 1/20

[52] U.S. Cl. ..... 53/124 B; 53/187; 53/255; 141/73; 141/257

[58] Field of Search ..... 53/124 B, 124 E, 124 TS, 53/125, 187, 255, 258; 141/73, 257

[56] References Cited

U.S. PATENT DOCUMENTS 2,553,684 5/1951 Soulen ..... 141/257 X 3,760,556 9/1973 Morris ..... 53/124 E X

*Primary Examiner*—Travis S. McGehee

*Attorney, Agent, or Firm*—Dugger, Johnson & Westman

[57] ABSTRACT

The present device comprises a bag filling apparatus which will clamp and hold a bag onto an output spout which forces in material such as pulverized or loose fill cellulose fiber used in insulation, and provides means for holding the bag in place, and providing a compressive force against the material as it is placed into the bag so that the material is forced into the bag and has substantial density when the bag is filled. The device includes means for automatically releasing the bag holder when the bag is filled a preselected amount.

15 Claims, 7 Drawing Figures

45
95
52
21
20
96
22
90
53A
52
46
43
82
15
86
75
76
80
80
16
26
14
11
11
27
10
12
26
25
28
31
13
24
32
23
23

R
S
105A
105
M
106
90
20
46
22
46A
107
91
43A
4
61
45
99
60
54
43
15
95
50
43
10
82
53
21
19A
22
80
96
93
92
27
34
19
73
12
26
94
28
36
35
74
75
24
31
33
25
37
32
76
13
23
38
70
71
72
23
39
60
71A
40
66
65
25
4

FIG. 5
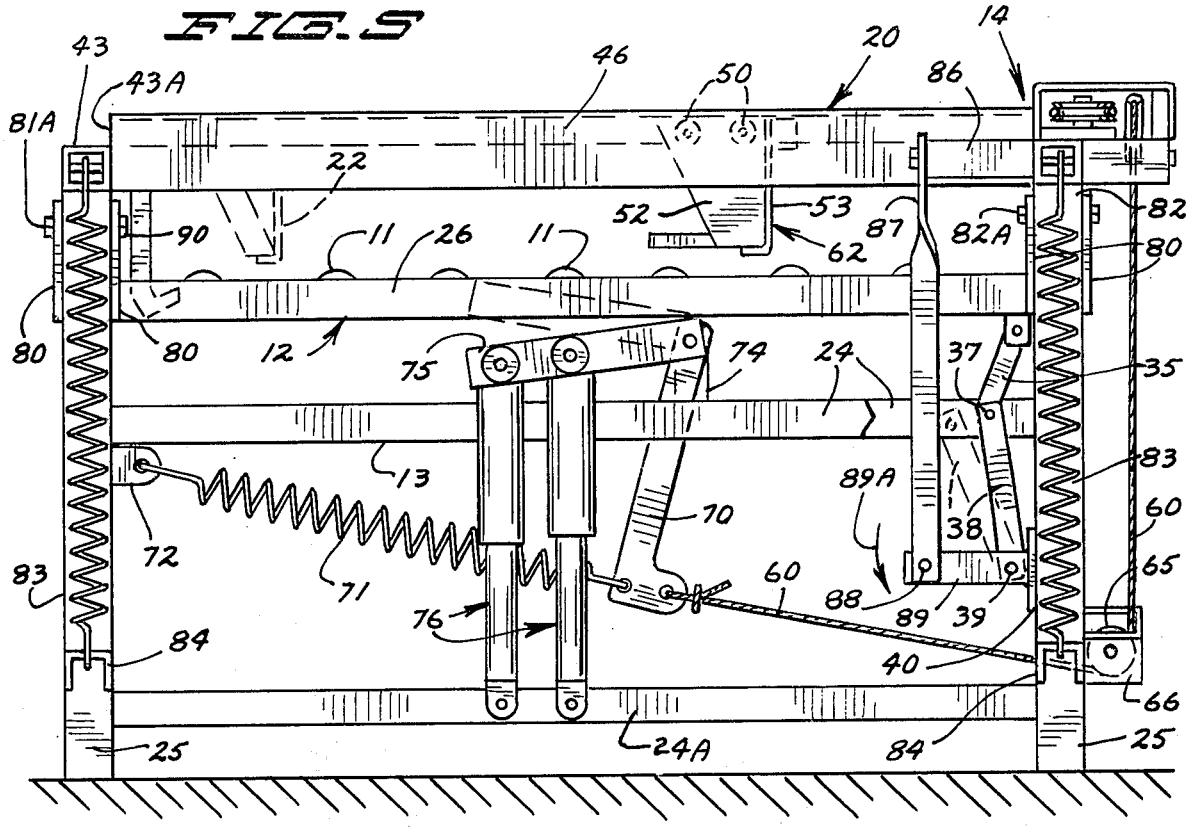
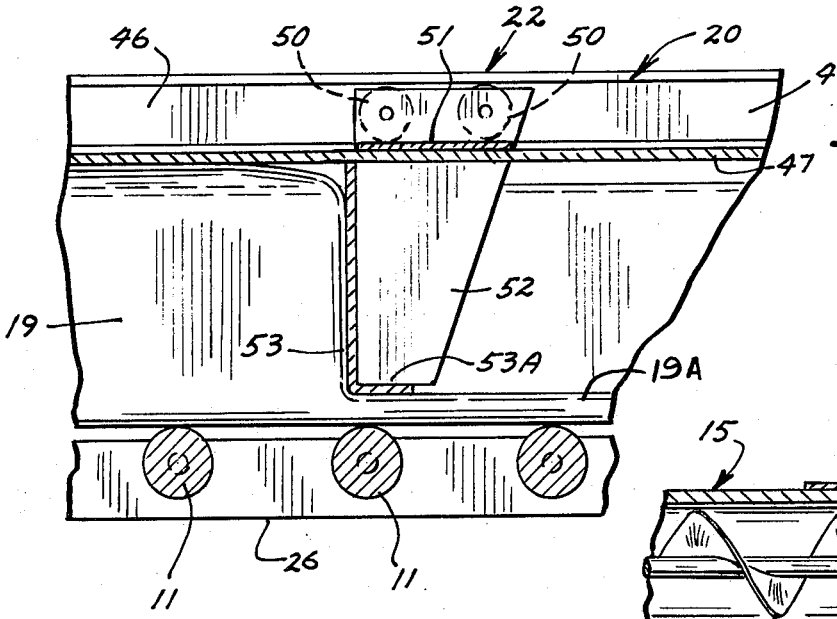
FIG. 6
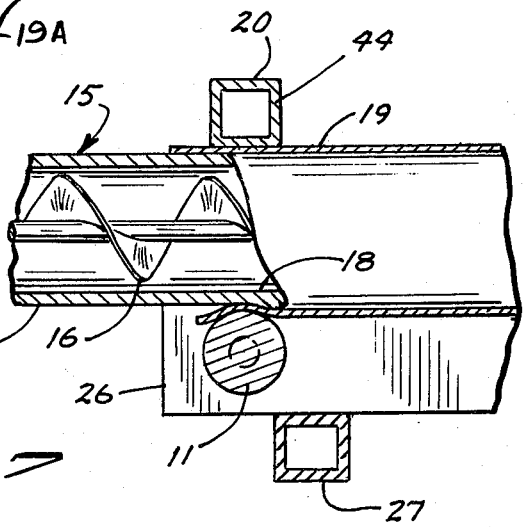
FIG. 7

BAG FILLING APPARATUS

BACKGROUND OF THE INVENTION

1. Field of the Invention

The present invention relates to bag filling apparatus for filling loose or particulate material into bags.

2. Prior Art

The filling of bags has long been done with a variety of devices, but problems in packing material that doesn't flow, such as loose fill insulation that is formed by grinding or pulverizing cellulose fiber still exist. The present device simplifies the job and makes sure that the bags are filled with the desired amount of density.

SUMMARY OF THE INVENTION

The present invention relates to a bagging apparatus comprising a table that supports a bag in its collapsed or flat position, and wherein the bag can be placed with the inlet opening to the bag surrounding an outlet spout from a filling device for filling in material such as loose cellulose fiber. A packer member that is spring loaded is placed above the bag, and as the bag is filled from the spout, the packer must be pushed against a spring load.

In so doing, the material filling the bag is packed to a desired density, and when the packer reaches the end of the bag, it automatically trips a release to release the packer, and at the same time the bag is released to permit it to be easily removed and sent on to a bag sewing machine.

The present device is relatively simple to make, and has an automatic return for returning the packer to its original (initial) position when the bag filling apparatus releases.

The bag packer moves under a bias load that can be adjusted, and in the form shown suitable shock absorber damper devices are used for preventing the packer from being returned to its original position violen tyl when the bag is full.

The unit opens with a hinged cover to permit access to remove full bags and insert new bags. The bag support also operates automatically to clamp the mouth or opening of the bag onto the filling spout.

The device is simple to make, easy to adjust, and provides fast accurate packing of bags.

BRIEF DESCRIPTION OF THE DRAWINGS

FIG. 5 is a side elevational view taken as on line 5—5 in FIG. 4;

FIG. 6 is a fragmentary enlarged side view of the bag packer taken as on line 6—6 in FIG. 3; and FIG. 7 is a fragmentary enlarged sectional view of a typical bag filling spout with the front portion of the bag shown clamped in position.

DESCRIPTION OF THE PREFERRED EMBODIMENT

Figure 1:
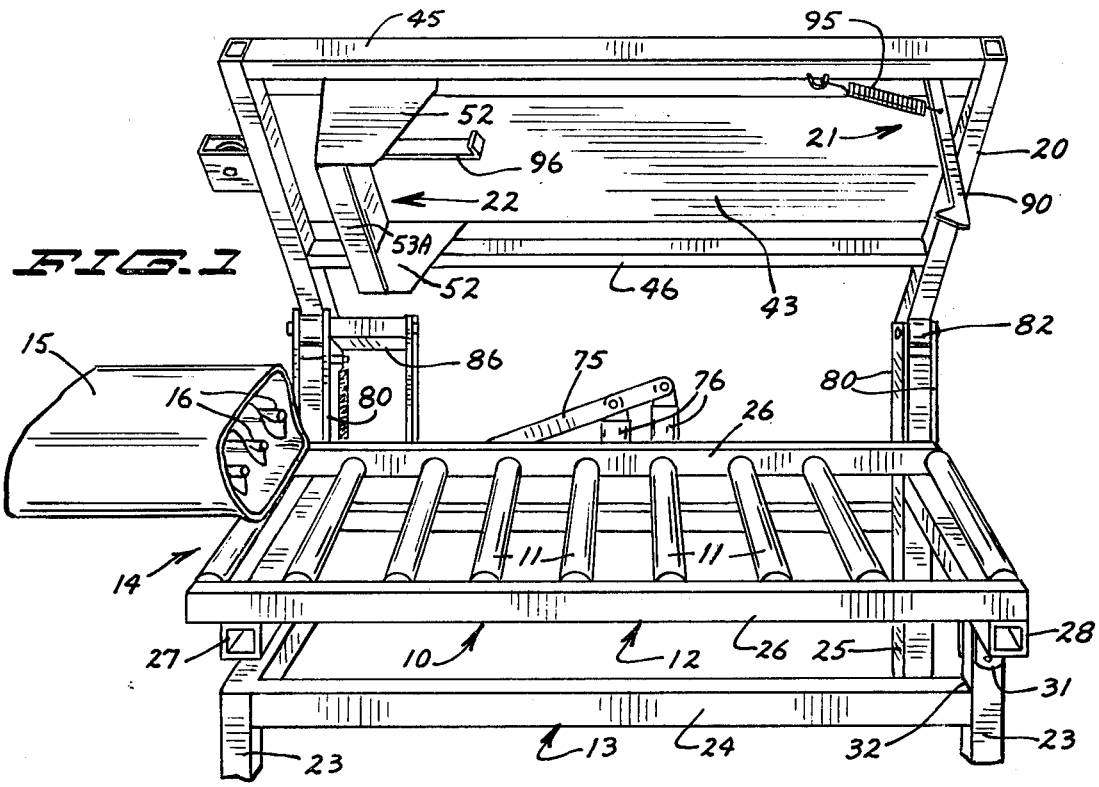
FIG. 1 is a perspective view of a bag packing apparatus made according to the present invention.

Referring first to FIG. 1, a support table illustrated generally at 10 as shown has a plurality of rollers 11 forming a bag support member. The rollers are mounted onto a frame 12 that is pivotally mounted to the main support frame 13 so that one end 14 adjacent a bag filling apparatus shown only schematically at 15 can be raised and lowered relative to the bag filling apparatus.

As shown, there are a plurality of augers 16 in the bag filling apparatus, and the augers are surrounded by a suitable spout 17 in which they operate. The end of the spout as shown in FIG. 7 is cut to have a lower lip 18, that will rest on the inside of a bag 19 placed over the spout, and when a cover indicated generally at 20 is lowered or closed the end 14 of frame 12 will lift up clamping a bag onto the spout.

The cover 20 is shown in its open position in FIG. 1, and a bag 19 (FIG. 2) can merely be laid onto the rollers 11 which are freely rotatably mounted in side frame members of frame 12, as is well known, and when the cover 20 is lowered it will be latched with a latch mechanism illustrated generally at 21 that cooperates with a latch roller on the conveyor frame 12. A compressor or packer head assembly 22 which is mounted on the cover will be in position to closely overlie the collapsed or unfilled bag 19 adjacent the end of spout 17, and as material is forced into the bag by the augers 16 the packer head or compressor 22 will be moved away from the spout against a spring load by the force of the material filling the bag, to cause compression of the material in the bag to a desired degree of density. Note that the bag has a length extending away from the spout from the open end to the opposite end, and when filled the thickness of the bag increases.

When the packer or compressor 22 moves to the opposite end of the cover member from that shown in its position in FIG. 1 it will trip the latch mechanism 21 and the cover 20 will be released. Springs are mounted for lifting the cover automatically, and as will be explained the packer head or compressor 22 is also spring loaded.

Referring to a more detailed showing in FIGS. 2 through 7, it can be seen that the main frame 13 includes upright legs 23 at the front corners thereof and legs 25 at the back corners. Longitudinally extending side members 24 are provided as well as cross members to make a rigid assembly. The frame is made to form a sturdy assembly, and as can perhaps best be seen in FIG. 4, the legs 25 on the backside of the machine are longer than the legs 23 on the front side, and extend upwardly to a level above the conveyor frame 12.

The conveyor frame 12 itself has longitudinally extending members 26,26 on opposite sides thereof, which rotatably mount suitable shaft members for the rollers 11 in a conventional manner. The longitudinal members 26,26 are joined together with first and second cross members 27 and 28, respectively, and it can be seen in FIGS. 2 and 4 that the cross member 28 carries two sets of ears 31 which receive lugs 32 that are spaced apart and joined to the cross member on the main frame 13. A pivot pin 33 is used for pivotally mounting each set of ears 31 to the respective lug 32 so that the entire conveyor frame assembly 12 pivots at the far end of the frame with respect to the feed spout, about a horizontal axis.

Figure 2:
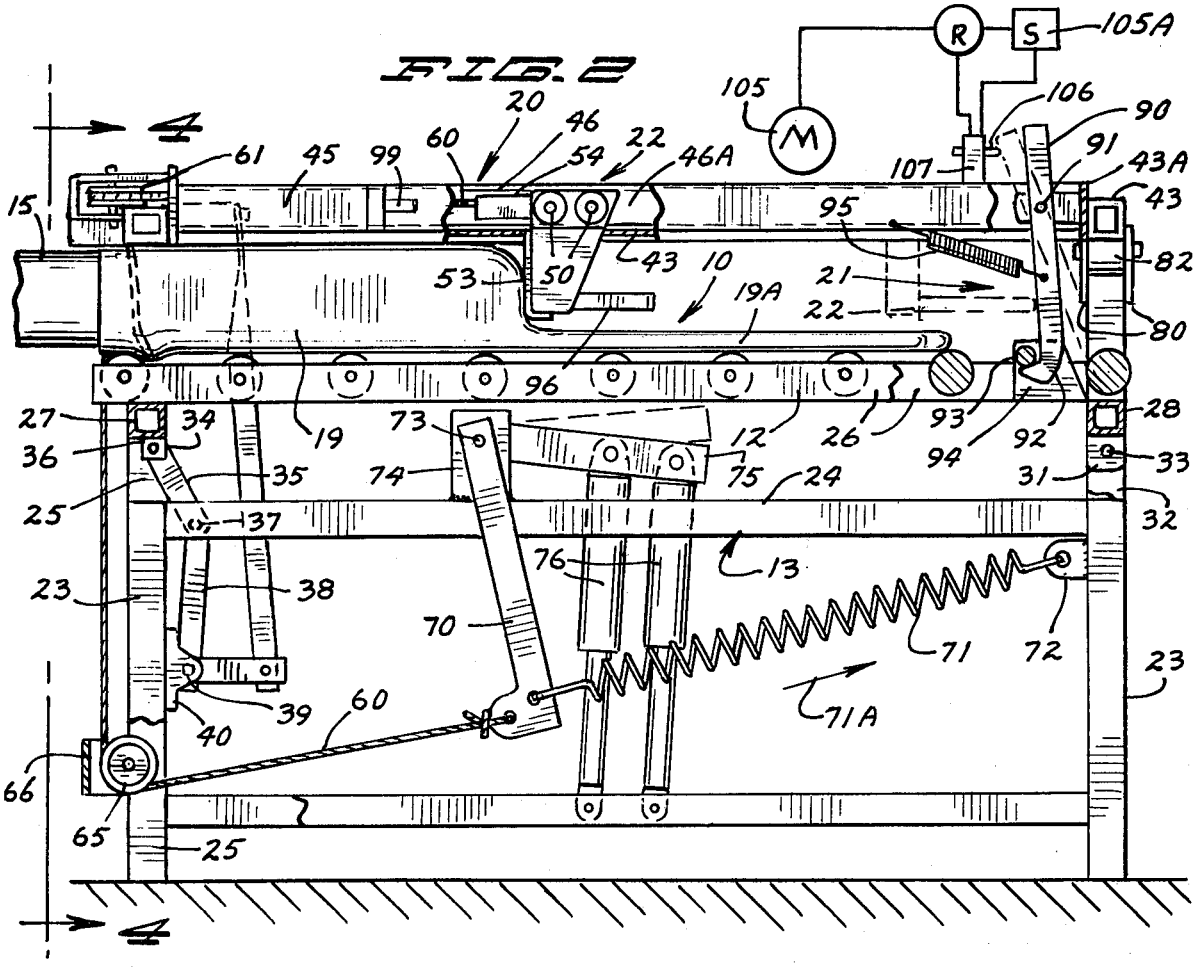
FIG. 2 is a side elevational view of the device of FIG. 1 with parts in section and parts broken away showing a bag partially filled.
Figure 4:
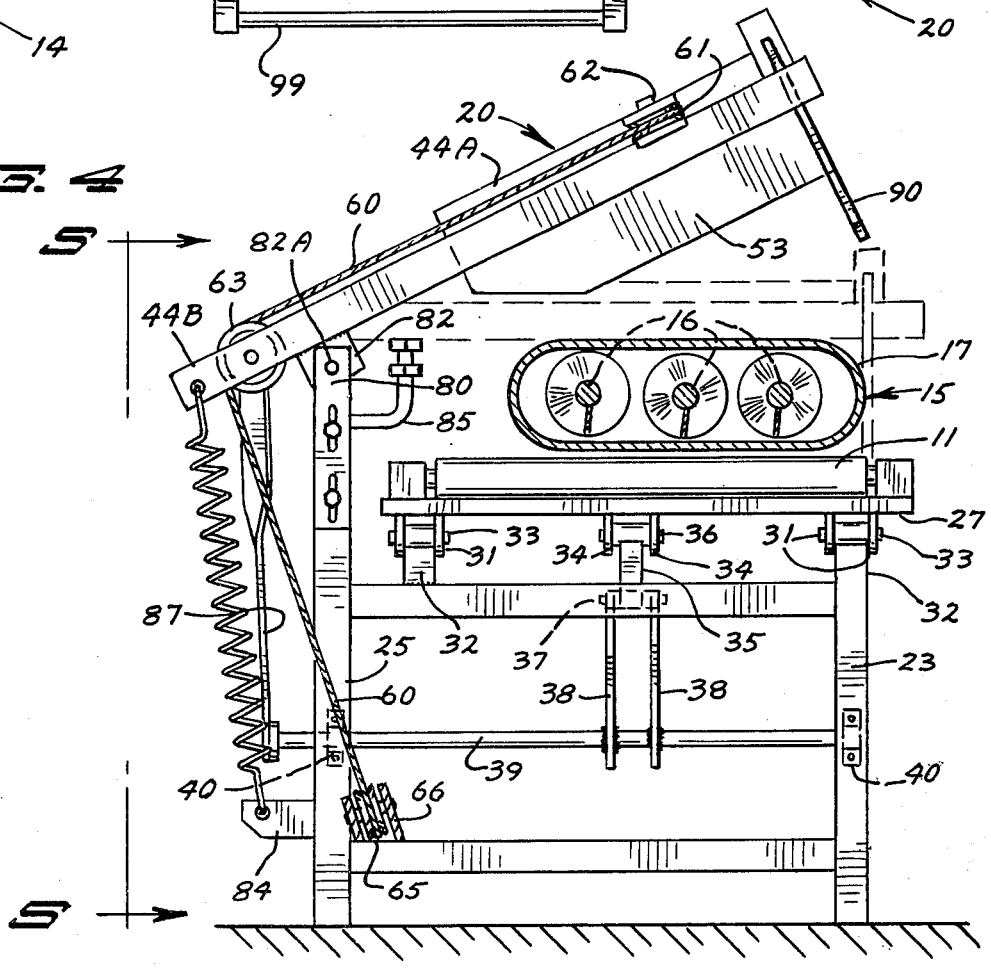
FIG. 4 is an end view of the device of FIG. 1 taken as on line 4—4 in FIG. 2.

At the end 14 of the frame adjacent the feed spout 17, the cross member 27, as can perhaps best be seen in FIGS. 2 and 4, has a pair of ears 34 that receive a link 35 that is pivotally mounted as at 36 at the ears, and the link 35 in turn is pivotally mounted as at 37 to a pair of arms 38 which form a second link in a toggle linkage assembly. The arms 38 in turn are attached to a shaft 39 that is mounted in suitable bearings 40. The bearings 40 are mounted on the upright posts 23 and 25 at the spout end, that is end 14 of the frame. The toggle linkage assembly comprising the links 35 and 38 control the position of the bag support assembly 12 about the pivots 33. The links move the end 14 of the bag support from a position wherein it is spaced from the lip 18, to a position where one of the rollers 11 tends to clamp the bag on the nozzle against spout 17 and lip 18.

The cover assembly 20 as shown is a unitary frame that has a pair of end arm members 43 and 44, respectively. The arm members in turn are fixedly attached to vertical plates 43A and 44A which form end portions of the cover. The plates 43A and 44A are connected together with side frame and track members 45 and 46 which extend longitudinally generally parallel to the side members of the bag support. The frame members 45 and 46 are fixed to the plates 43A and 44A, and thus to the arms 43 and 44.

A guide plate 47 is welded between the end plates 43A and 44A, and extends longitudinally above and substantially parallel to the plane defined by the upper edge portions of the rollers 11. The plate 47 has side edges that are spaced from the side frame members 45 and 46, respectively so that there are openings between the side edges of the plate 47 and the respective side members 45 and 46 that extend for the length of the cover that is, between the arms 43 and 44. The upper portions of the side members 45 and 46 form tracks, which are channels having inwardly facing legs, and the track on member 46 is indicated at 46A in FIG. 2. There is a corresponding track in the upper edge portions of the channel 45. The tracks are made to receive and support guide rollers 50 that are mounted on opposite sides of the packer head 22. The packer head as shown has a cross plate 51 that is parallel to and may ride upon the plate 47. Suitable low friction guide strip may be used between the plates 47 and 51. In the spaces or openings defined between the side frame members 45 and 46 and the edges of the plate 47 there are depending side plates 52 fixed to plate 51, one on each side of the plate 47. The side plates 52 in turn support a packer head face plate 53 at the forward edges thereof, and as can be seen in FIG. 6 for example that the packer face plate 53 is below plate 47 and has a lower edge flange 53A that is attached to the bottom edge of the side plates 52. It can be seen that this flange 53A clears the plane defined by the upper edges of the rollers 11 by a small amount, and will be used to hold an unfilled portion of a bag flat until the material in the bag pushes the packer head 22 out of the way as the bag is filled and the bag expands between the packer head and the spout.

Two rollers 50 are rotatably mounted on each of the plates 52, and are spaced to provide fore and aft stability. The rollers fit fairly snuggly in the channel shaped tracks on members 45 and 46 and the plate 51 as well as the packer head face plate 53 are guided by the plate 47 to prevent the packer head from cocking or tilting.

A connecting bracket 54 (FIG. 3) can be attached to the leading edge of the plate 51, in a suitable manner, and a cable 60 is connected to this bracket 54. The cable 60 as shown in positioned above the plate 47, and passes over a first cable guide sheave 61 that is mounted in a suitable bracket 64 that is attached to the plate 44A and the arm 44, and the cable 60 then passes over a second sheave 63 that is mounted in a support 64 adjacent the end of the arm 44. The cable then passes downwardly to a guide sheave 65 that is mounted in a bracket 66, and it can be seen in FIG. 4 sheave 65 is at an angle to properly guide the cable from the sheave 63 down to near the lower portion of the main frame 13.

Referring to FIGS. 2 and 5, it can be seen that the cable 60 is passed from the sheave 55 upwardly underneath the frame and connects to a lever 70 of a bell crank assembly. The lever 70 also is connected to a suitable spring 71 which has its opposite end connected to an ear 72 that is fixed with respect to the frame 13. The spring 71 exerts force in direction as indicated by the arrow 71A, and will tend to pivot the lever 70 about a bell crank pivot pin indicated at 73. The pin 73 is rotatably mounted in a suitable support 74 that is attached to the upper longitudinally side member 24. The opposite end of pin 73 is attached to a arm 75, to form the bell crank so that when the lever 70 is moved the arm 75 also moves.

A pair of dampening dash pot assemblies made of automotive type shock absorbers are indicated generally at 76 and are of conventional design. First ends of the shock absorbers are connected to the arm 75, and the opposite ends of the shock absorbers are connected to a lower support member 24A of the frame 13.

It can thus be seen that the tension exerted by spring 71 on the cable 60 is transferred around the sheaves 65, 63 and 61 so that the tension in cable 60 tends to urge the packer head 22 toward the end of the cover adjacent the feed spout 17.

Spring 71 exerts a resilient force on the packer head 22 at all times, and the shock absorbers 76 serves to dampen movement during return of the packer head 22 to its original position.

The arms 43 and 44 of the cover are pivotally mounted to the rear upright legs 25. Each of the legs 25 has a pair of ears 80,80 on opposite sides thereof which receive a pivot lug 81 and 82, respectively. The pivot lug 81 is on arm 43, and the lug 82 is on arm 44. The ears 80,80 can be adjustably mounted for vertical adjustment along the legs 25, to provide for mounting the cover correctly, and making for adjustments that might be necessary to obtain satisfactory operation.

The arms 43 and 44 extend on the opposite side of the pivot pins 81A and 82A from the main direction of extension of the cover (see FIGS. 3 and 4) and on the outwardly extending end portions indicated at 43B and 44B, there are tension springs 83 attached. These tension springs 83 are also attached to lugs 84 that in turn are mounted to the lower portions of the posts 25. The springs thus create a force tending to pivot the arms 43 and 44 to lift the outer frame member 45 and spring the cover member 20 away from the bag support 12. The pivot pins 81A and 82A can be any desired type of pin that will adequatly hold the cover assembly in position. The pivoting of the cover may have some effect on the tension in the cable 60, but not a significant amount when viewed in relation to the amount of tension exerting on the spring 71 by movement of the packing member 22 longitudinally along the cover as the bag fills.

A suitable stop mechanism 85 that is adjustable and is shown in FIG. 4 can be fixed to each of the legs 25 to provide a stop for the respective arms 43 and 44 and permit adjustment of the stopped position of the cover when it is in its working position.

Figure 3:
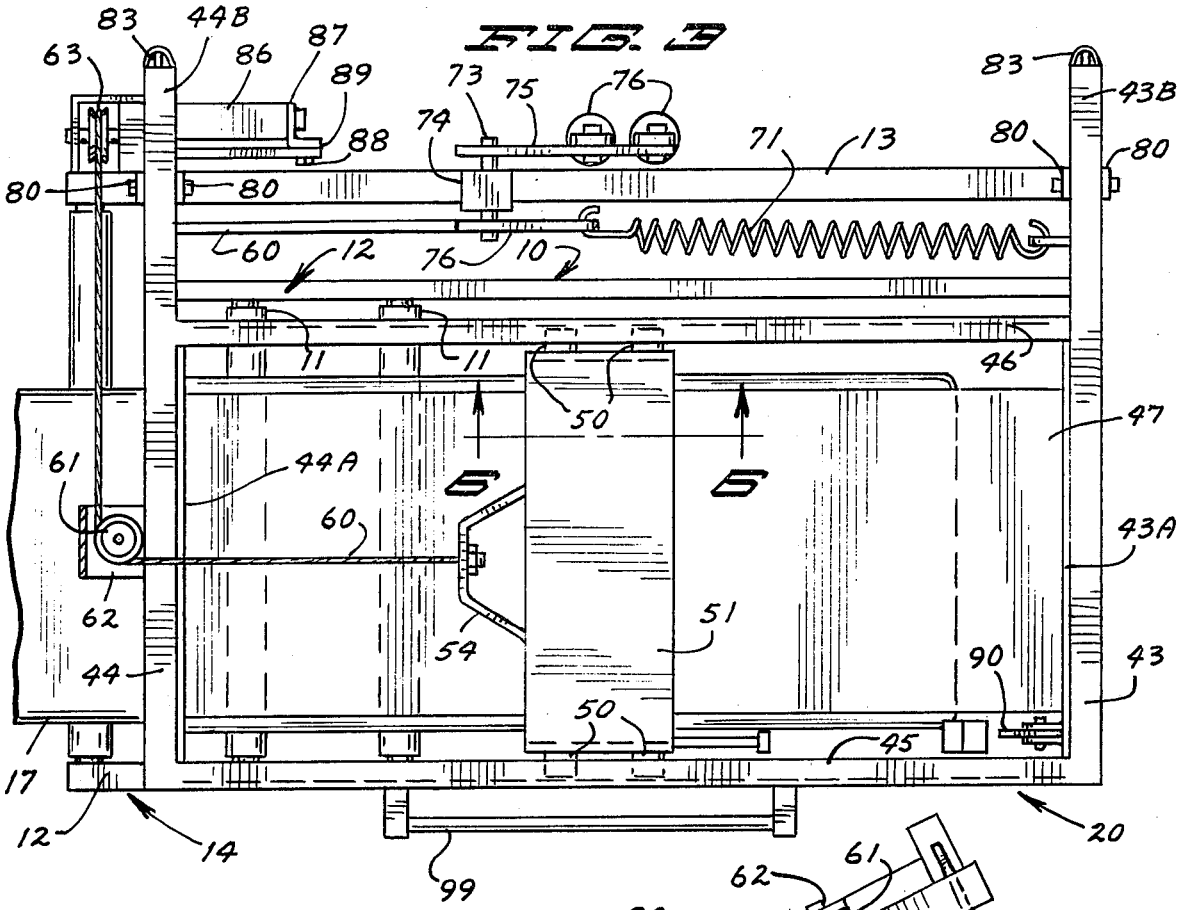
FIG. 3 is a top plan view of the device of FIG. 1.

The arm 44 has an actuator block 86 fixed thereon that extends laterally out from the arm and at the outer end of block 86 a link 87 is pivotally mounted (see FIGS. 3 and 5). The link 87 as shown is a flat bar that is twisted 90° between its ends so that it pivots about an axis parallel to the longitudinal direction of the cover at block 86, and pivots about a horizontal axis at right angles to the upper axis at its lower end as indicated at 88 (FIG. 5). The pivot 88 connects the link 87 to a lever 89 that in turn is drivably mounted onto the shaft 39, and this shaft forms a rock shaft or bell crank so that any movement of the lever 89 will cause movement of the levers or links 38 and 35, and consequently control movement of the end 14 of the bag support member 12 that is adjacent the bag filling spout.

Thus, it can be seen that when the cover 20 is in its raised position as shown in FIG. 4 the link 87 will be moved downwardly as shown by the arrow 89A in FIG. 5 tending to move the lever 89 downwardly and relax the pressure against the end 14 of the conveyor frame 12. The conveyor frame of course will tend to lower under gravity, and as it pivots about the pivots 33, the link 87 can control this movement. When the cover is closed about the pivot 81A and 82A, the ends 43B and 44B of arms 43 and 44 will raise, and the link 87 will be placed in tension. This will pull on the lever 81, and pull the outer end thereof upwardly tending to pivot the lever 38 toward an on center position relative to the link 35, and will of course move the end of the bag support frame 12 and the support rollers 11 upwardly.

When the cover is moved toward its closed or lowered position so that the arms 43 and 44 will move generally horizontally, the latch assembly 21 will operate to latch the cover 20 in its closed position against the action of the springs 83 which tend to flip the cover up or open. The latch assembly 21 comprises a latch hook 90 that is pivotally mounted on a suitable pin 91 between ears welded to the plate 43A. The latch hook 90 has a camming surface 92 (FIG. 2) that causes the latch hook to ride over a latch pin 93 that in turn is mounted onto suitable plates 94. The plates 94 are spaced apart plates mounted onto the cross member 28 of the bag support 12, and the latching assembly is spaced between two of the rollers 11 on the bag support 12 in a convenient manner. A spring 95 is urged to urge the latch hook to a latched position, and the latch hook 90 can be stopped in a desired position through the use of a stop member or the like. The compressor assembly 22 carries a latch actuator or release member 96 that extends so that it will intercept or strike the latch 90 as the compressor assembly is moved to its fully extended (bag full) position, and when it does move to this position as shown in dotted lines, it will move the latch hook 90 away from the pin 93, releasing the cover 20. The springs 83 will then flip the cover upwardly about pivots 81A and 82A.

A suitable handle 99 is fastened to the outer edge of the cover 20 to permit manual closing of the cover against the action of springs 83.

In operation, when the unit is in its position shown in FIG. 1 the compressor packer head 22 will be all the way toward the spout end under the urging of the spring 71 and control of cable 60. When the cover is opened as shown, a bag which is indicated in FIG. 2 at 19, and which is an ordinary paper bag used for bagging loose insulation at the present time is folded flat when supplied as shown in the portion 19A. The flat bag will be laid on the bag support rollers 11 and the open end of the bag will be expanded to fit over the spout 17. The lip 18 is made so that the bag can easily be slipped over the lip and it should be noted that the rollers 11 will be spaced downwardly from this lip because of the action of the linkage 38 and 35 lowering the frame 12 about its pivot 33. While there is a generally close fit between the inside of the bag and the spout 17 the bag does not have to be sufficiently tight so that there is an interference fit.

The bag is slipped over the spout and the flat end 19A (collapsed portion) of the bag is laid down along the top of the rollers 11 and extends along the roller bed. Then, the cover 20 is closed. As the cover closes, the link 87 moves up, pulling on lever 89 and in turn rotating the shaft 39, and actuating arms 38 to push upwardly on the pivot 37 and on line 35 which in turn lifts the conveyor frame end 14 upwardly. The end roller 11 which is underneath the lip 18 of the spout will clamp the bag. If the lip has a bead around its edge, which is common, the clamping action of the roller will hold the bag securely onto the spout 18. At the same time, the arm 44 comes down across the top of the spout 17 and clamps the bag onto the top of the spout. Suitable adjustments can be made to insure that this clamping occurs, either by changing the length of links, or the position of the stop assembly 85. Further high friction material can be placed on the bottom of the arm 44, such as elastomeric material (tire carcass or the like) to provide for some compression and friction holding.

When the latch 21 latches, the cover 20 will be held in its closed position as shown in FIG. 2 with the latch hook 90 under the pin 93, and because the compressor or packer head 22 is in its first position, the spring 71 will be compressed, and the hydraulic shook absorbers or dash pot assemblies 76 will be extended. Then, a motor 105 to drive the feed augers which is indicated generally at 105 can be started with a suitable switch 105A, and it can be seen that the switch 105A controls a relay and is wired in series with a limit switch 106 that in turn is mounted on a support 107 that is attached to the side frame member 45.

The limit switch 106 is positioned to align with the upper end of the latch hook 90, and in the position when the cover 20 is latched and the packer 22 is at its initial position, the latch hook will be spaced from the limit switch. The motor 105 will drive the augers 16 through suitable drive mechanism such as chain or belt drives which are not shown, and the auger feeders will force the material out through the end of the spout 17, and into the bag 19 placed on the spout.

As the material enters the first portion of the bag near the open end on spout 17, it will start to build up and expand the thickness of the bag 19 from its flat condition and this will tend to urge the bag 19 against the plate 53 of packer head 22. The force of material being packed into bag 19 will create a force tending to roll the compressor or packer head 22 along the tracks 45A and 46A through rollers 50. The edge member 53A extends across the width of the bag and is sufficiently close to the bag support so fill material will not be permitted to pass under the edge 53A. As this happens of course the cable 60 will pick up load and transfer the load to the lever 70 which in turn causes extension of the spring 71. This will load the packer head 22 so that the material being packed in the bag 19 will meet with resistance that is a function of the spring load from spring 71. However, the spring is adjusted so that the packer head 22 will roll along the tracks 45A and 46A and will cause packing of the material in the bag 19 that is a sufficient amount to achieve the density desired.

A midway position in filling the bag is shown in FIG. 2, with the portion of the bag that has been expanded between the packer head 22 and the filling chute 17, and the flattened portion of the bag 19A is still unfilled. The plate 47 also keeps the bag contained as the bag is filled to prevent distortion of the bag.

The packer head 22 moves as the bag is filled, and when the bag is full, the actuator 96 will engage the latch hook 90 below the pivot pin 91, and push the latch hook off the latch pin 93. When this happens, the limit switch 106 will be opened breaking the circuit to relay 105A controlling the motor 105, shutting off the motor which powers the augers 16, and at the same time of course the springs 83 will flip the cover 20 open. As soon as the cover is flipped up the load on the packer head 22 will be released, and the spring 71 will tend to pull on the cable 60 and snap the packer head 22 back toward the filling chute. However, the shock absorbers 76, acting as dash pots will prevent excessively rapid action, and will dampen the return movement of the packer head to a reasonable level so that severe shock loads aren't encountered. The shock absorbers, as previously explained act through lever 75 on a common shaft 73 that is controlled by lever 70.

The link 87 will move down also when the cover opens, and arm 89 will pivot shaft 39 to lower the end 14 of the bag support frame and relieve the clamping action between the end roller 11 and the lip 18, and the clamping action between the upper arm 44 and the spout 17 will also be relieved. Then the full bag can be removed, and sewn closed for storage.

Also, the spring 71 can be adjustably mounted if desired, as can the springs 83 to adjust the forces that are encountered in use.

Automatic filling is achieved with uniform packing and automatic release when filled. Interlock controls to grinding machines for grinding cellulose fibers may be used.

What is claimed is:

1. A bag filling apparatus comprising a filling spout of size to fit within the opening of a bag to be filled, support means for a bag to be filled comprising a first member for supporting a collapsed bag to be filled in a position extending from the filling spout, and a second member mounted with respect to said support means and positioned to overlie said first member, means on said second member comprising a packer head having an edge positioned adjacent said first member whereby a bag in collapsed condition only may be positioned between said edge and said first member, and said packer head having a surface facing the filling spout, and bias means resiliently permitting said packer head to move away from said filling spout as a bag is filled to thereby cause packing of contents in a bag at a density as desired.

2. The combination of claim 1 and latch means between the first and second members, and release means to release said latch means to permit said second member and said packer head to move from position overlying said first member when a bag on the spout is filled a desired amount.

3. The combination as specified in claim 1 wherein said first member comprises a support table positioned generally horizontally, and said filling spout comprises auger means for forcing material into a bag placed on said spout.

4. The combination as specified in claim 1 wherein said packer head edge extends generally across the transverse width of a bag supported on said first member in collapsed condition.

5. The combination as specified in claim 1 wherein said second member comprises a cover overlying said first member, means biasing said cover to an open position spaced from said first member, release means comprising latch means between said first and second members holding said second member in position, and means on said packer head to release said latch means when a bag held on the spout is filled a desired amount.

6. The combination as specified in claim 5 and interlock means for controlling desired operations of said filling apparatus, said interlock means including a switch which is disabled as said latch means is released.

7. The combination as specified in claim 1 wherein said means biasing said packer head comprises a spring member, said spring member being extended as said packer head is moved away from said spout.

8. The combination as specified in claim 7 and dash pot means to dampen action of said spring member tending to return said packer head to its original position.

9. The combination as specified in claim 1 wherein said support member includes a frame, said first member being pivotally mounted on said frame at locations spaced from said filling spout and having an end portion adjacent said spout movable toward and away from a first position to tend to clamp a bag against at least a portion of said spout, said second member being pivotally mounted on said frame, and means to control pivotal movement of said first member including a linkage connected between said first and second members and operative in response to movement of said second member to a position overlying said first member to move said first member to its position to tend to clamp a bag onto said spout.

10. The combination as specified in claim 1 wherein said first member includes track means, said packer head being mounted in said track means for longitudinal movement toward and away from said spout, a cable connected to said packer head, guide means to guide said cable for movement under tension, said bias means comprising spring means attached to an opposite end of said cable means for resisting movement of said packer head, said spring means being positioned generally below said first member and extending in the direction of longitudinal extension of said first member, said cable means carrying tension from said packer head to said spring means.

11. Support and packer means for a bag to be filled from a spout through which low density compressible material is discharged under force, including a frame, a generally horizontal member movably mounted on said frame and movable to position to clamp at least one side of a bag to be filled against said spout to hold such a bag onto said spout, a packer head, means mounting said packer head for movement from a first position adjacent said spout wherein said head overlies a bag in collapsed unfilled condition and interferes with and resists expansion of a bag as material is forced into a bag held on the spout and supported on the generally horizontal member, said packer head being movable away from said spout as material fills a bag thereby causing packing of material into a bag, and bias means resiliently resisting movement of said packer head away from said spout.

12. The combination as specified in claim 11 wherein said means mounting said packer head comprises a spring loaded cover member overlying said generally horizontal member with the packer head in its first position, said cover being urged to an open position with the packer head spaced from a bag on the horizontal support, and latch means for latching said cover with the packer head in position adjacent said spout, means to release said latch means when said packer head member has been moved away from said spout a desired amount.

13. The combination as specified in claim 10 wherein said bias means for said packer head comprises a tension spring, a bell crank mounted onto said frame, said tension spring being connected to one arm of said bell crank, flexible means connected between said packer head and said bell crank tending to cause said spring to extend as the packer head moves away from said spout, dash pot means connected to other portions of said bell crank from said spring to restrain rapid movement of said bell crank means.

14. The combination as specified in claim 12 wherein said generally horizontal member includes a movable portion, wherein said cover member includes a portion positioned to engage a portion of a bag that is held on said spout, said movable portion being movable to clamp a lip portion of said bag to said spout as the cover member moves to its closed position.

15. The combination as specified in claim 14 wherein said cover member has a side member which tends to clamp a bag position on said spout against said spout when the cover member is in latched position.

* * * * *

UNITED STATES PATENT AND TRADEMARK OFFICE

CERTIFICATE OF CORRECTION

PATENT NO. : 4,054,018

DATED : October 18, 1977

INVENTOR(S) : Chester G. Neukom

It is certified that error appears in the above-identified patent and that said Letters Patent are hereby corrected as shown below:

Column 1, line 38 "violen tyl" should be --violen tly--. Column 10, line 12, (Claim 15, line 3) before "position" insert --in--.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*